United States Patent [19]

D'Andrea

[11] Patent Number: 5,031,935

[45] Date of Patent: Jul. 16, 1991

[54] BOOK WITH PAGES CONTAINING APERTURES THAT SUPERIMPOSE IMAGES

[76] Inventor: Deborah B. D'Andrea, 734 Mentor Rd., Akron, Ohio 44303

[21] Appl. No.: 413,320

[22] Filed: Sep. 27, 1989

[51] Int. Cl.[5] ..... B42D 1/00; B42D 15/00

[52] U.S. Cl. ..... 281/15.1; 281/38; 283/63.1

[58] Field of Search ..... 281/15.1, 38; 283/63.1

[56] References Cited

U.S. PATENT DOCUMENTS

| | | | |
|---|---|---|---|
| 1,028,921 | 6/1912 | Wagner | 283/63.1 |
| 1,168,392 | 1/1916 | Gruettner | 283/63.1 |
| 2,489,240 | 11/1949 | Meyer | 46/34 |

FOREIGN PATENT DOCUMENTS 705459 3/1954 United Kingdom .

*Primary Examiner*—Paul A. Bell

*Attorney, Agent, or Firm*—Oldham & Oldham Co.

[57] ABSTRACT

This invention relates to a book for young readers which contains pages with apertures cut therein, such that the apertures are capable of superimposing images affixed to the front and rear covers.

6 Claims, 1 Drawing Sheet

BOOK WITH PAGES CONTAINING APERTURES THAT SUPERIMPOSE IMAGES

TECHNICAL FIELD

Generally, the present invention relates to books which are entertaining and which can be personalized for a child reader. More specifically, the present invention relates to books for young readers in which images of subjects significant to the reader are affixed to an inside cover of the book and subsequently appear on a number of pages through an aperture on each page which superimposes the subject. The images are positioned on the inner surface of each cover in such a manner that each aperture functions to superimpose the image into the page when placed against either cover. Preferably, the page illustrations incorporate and the text references the superimposed subjects.

BACKGROUND

Over the years, many variations of the standard children's book have been developed. Books shaped similar to a figure discussed in the book, books made of various materials, and books with hinged flaps concealing illustrations, are all well known in the art. A popular type of book among young readers is the pop-up book containing illustrations that spring out perpendicular to the open page.

Yet another variation of the standard children's book utilizes holes or apertures cut out of a number of pages in the book. Many of these books use the hole to disclose only a portion of a larger illustration on the following page, requiring the young reader to use imagination and reasoning to guess the identity of the larger illustration.

U.S. Pat. No. 1,028,921 to Wagner discloses a book with a design placed on the book's rear cover with a portion of the design in relief. Additionally, each page contains a design with an aperture cut therein. The apertures of each page are in registry with one another so that any page folded flat onto the rear cover superimposes the relief portion of the rear cover and completes the design on the respective page. However, the apertures only superimpose a relief design on the rear cover. The apertures are non-functional when the reader views the back surface of any page.

U.S. Pat. No. 2,489,240 to Meyer discloses a book with a mirror affixed to the front cover of the book. A hole or aperture is cut out of each page. The apertures of each page are in registry with one another. The front surface of each page contains printed matter corresponding to the illustration on the back of that same page. The illustrations on the back of each page are incomplete representations of a person with the head portion replaced by an aperture. Any page placed flat against the front cover exposes the mirror through the aperture. The reader's face in reflection completes the illustration. Although the front surface of each page contains printed matter, the apertures are non-functional when viewing the front surface of each page.

A Great Britain Patent, 705,459, discloses a book with a human figure on the rear cover. The front surface of each page shows various sets of clothing and contains at least one aperture. This aperture is positioned so as to exclude the human head from the design on the page. Each page when opened against the rear cover presents a human head appearing through the aperture to complete the illustration. However, the apertures only superimpose figures affixed to the rear cover. Therefore, the apertures are non-functional when viewing the back surface of each page. It was also disclosed that a photograph could be used to achieve the same purpose.

SUMMARY

The present invention relates to a book for young readers in which images of subjects significant to the reader may be attached to the inner surfaces of a book's front and back cover such that these subjects appear on each page of the book through an aperture with superimposes the subject.

Each page contains at least one aperture. Unlike the prior art, the apertures and the images are organized such that each aperture superimposes a subject when viewed from either the front or the back of each page. These images may be permanently affixed to the book cover or temporarily held in place such that the images could be changed if so desired. However, illustrations are permanently affixed to the front and rear cover so that this image always appears through the apertures and the book functions without requiring images provided by the reader. Images supplied by the reader are simply placed over the provided illustrations.

It is an object of the present invention to provide a book with pages that superimpose images which are significant to the reader.

It is also an object of the present invention to provide a book that provides increased enjoyment and entertainment because of the personalization to the reader.

It is an object of the present invention to provide a book in which each aperture on a page can function to superimpose an image on both the front and back covers.

It is an object of the present invention to provide a book which permits superimposed images to be changed repeatedly.

It is a further object of the present invention to provide a book in which the apertures function to superimpose images and thereby complete the story without requiring the reader to supply additional images.

These and other objects and advantages of the present invention are accomplished by a book comprising a front cover with an inner and outer surface; a rear cover with an inner and outer surface, a plurality of leaves hingedly bound between said front and back covers, each leaf having at least one aperture cut therein, each aperture being in registry with an aperture on the adjacent pages; at least one image affixed to the inner surface of said front cover or the inner surface of said rear cover such that each aperture is capable of superimposing one image on each cover when said book is open; and said images when superimposed complete the design on each respective page.

BRIEF DESCRIPTION OF THE DRAWINGS

The objects and advantages of the invention will become more readily apparent from the detailed description of preferred embodiments taken in conjunction with the drawings wherein.

DETAILED DESCRIPTION OF THE PREFERRED EMBODIMENT

Figure 1:
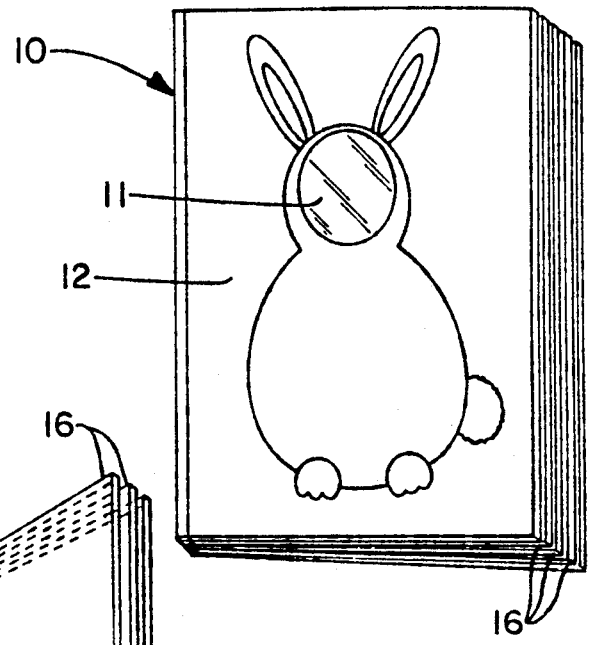
FIG. 1 is a front elevational view of a book containing apertures in the pages which superimpose images.
Figure 2:
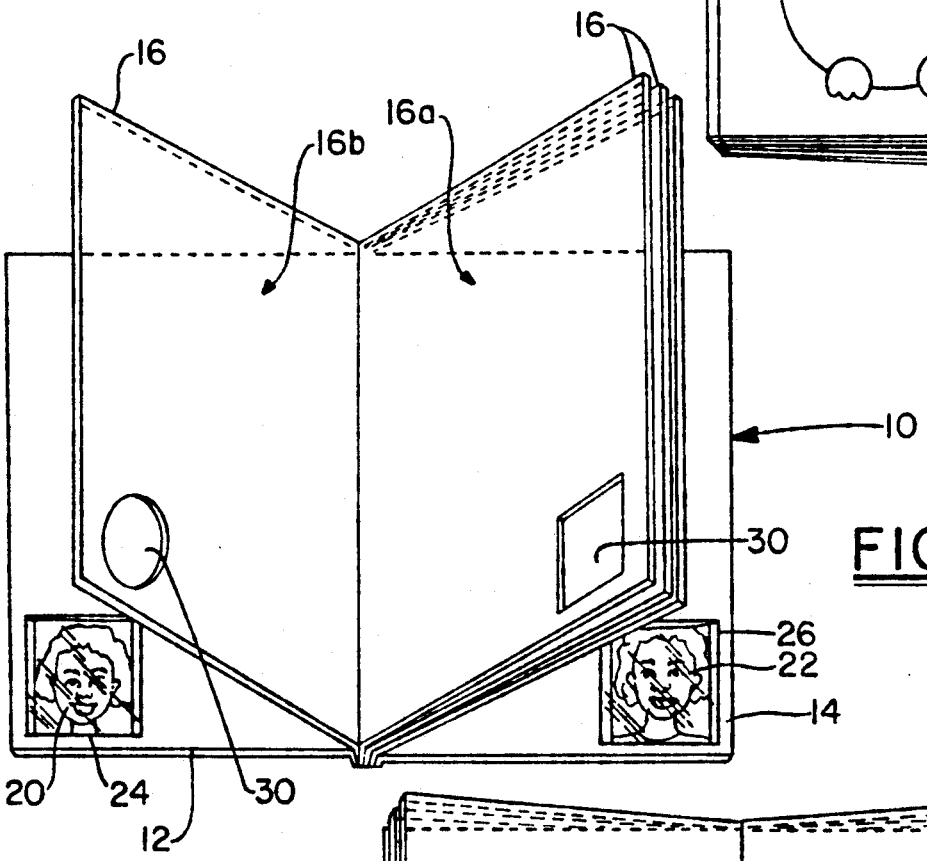
FIG. 2 is a top elevational view of a book containing apertures in the pages which superimpose images illustrating one embodiment utilizing the images and apertures.
Figure 3:
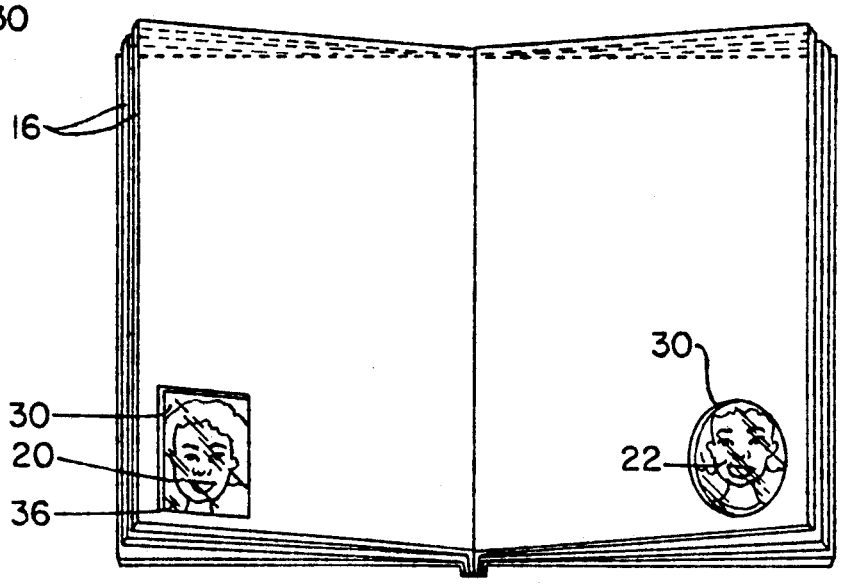
FIG. 3 is a top elevational view of a book containing apertures in the pages which superimpose images illustrating one embodiment and the relationship between the images and the apertures.

Now with reference to the present invention illustrated in the drawings, FIGS. 1-3 show a book 10 containing apertures 30 in the pages 16 which superimpose images 20 and 22. The book 10 possesses many characteristics of a standard children's book. A distinguishing feature is found in the apertures 30 cut in the pages 16 such that they are capable of superimposing images 20 and 22 located on both the front and rear covers 12 and 14 of the book 10, onto the pages 16 of the book 10. The superimposed images act to complete the illustrations on the front and rear surface of each page 16 discussed in the page's accompanying text.

The front cover 12 in FIG. 1 shows an animal, a character or the like on its outer surface. A portion of this figure, such as the face, has been replaced with a recessed area containing a mirror 11. The recessed area is shown in the drawings as oval but could essentially take on any shape. The mirror 11 is made preferably from a sheet metal such as aluminum but coated glass or a reflectively coated polymer film could be used as well as other materials known in the art. One such coated polymer film is commonly sold commercially as Mylar®. A true and accurate reflection is preferred but not required. Any material which yields a reflection sufficient to complete the illustration is adequate. A slot or means of affixing an image of the child to this recessed area is also contemplated.

The book 10 is made from conventional paper products known in the art. It is desirable that the front and rear covers 12 and 14 be of rigid construction for protecting the contents. Because it is contemplated that the product will be used primarily by young children, the pages may possess a more rigid structure than found in ordinary books. Likewise, the book 10 which is the subject of this invention could be manufactured out of many other materials including cloth or other suitable material.

The pages 16 of the book 10 are hingedly bound between the front and rear covers 12 and 14 of the book 10. A book 10 utilizing a spiral binding may also be contemplated.

The pages 16 of the book 10 contain illustrations and/or text on the front and rear surfaces **16*a* and 16*b* of each page 16. Each page 16 also contains at least one aperture 30. Each aperture 30 is in registry with corresponding apertures on adjacent pages 16. The apertures 30 on each page effectively remove a portion of the illustration on the front and rear surfaces 16*a* and 16*b* of each page 16. The preferred embodiment shows the apertures 30** as generally removing the facial portion of the illustrations. Apertures of essentially any shape are contemplated.

The pages 16 may contain more than one aperture provided that each aperture is in registry with apertures on all adjacent pages. Furthermore, additional images 20 and 22 must be affixed to the covers 12 and 14 such that all apertures 30 superimpose images affixed to said front and back covers regardless of whether the pages are viewed from the front or back surface **16*a* and 16*b* of each page 16**.

The preferred embodiment encourages the reader to supply images 20 and 22 of subjects significant to the reader. These images may include photographs, pictures, drawings, etc. of persons, pets, fictional characters or the like. These images 20 and 22 are used to complete the illustrations printed on the front and rear surfaces **16*a* and 16*b* of each page 16**. In the preferred embodiment completion of the illustrations require the images to contain facial features. However, other embodiments contemplate many variations of possible images.

As shown in FIG. 2, these images 20 and 22 are affixed to sections of the inner surface of the front and rear covers 12 and 14 which correspond with the apertures 30 of each page 16 such that the apertures 30 when laid flat against the respective book cover superimpose images 20 or 22. The image 20 or 22 when superimposed by the respective page 16 completes the illustration and the illustration is referenced generally in the text of that page.

The images 20 and 22 may be affixed to the front and rear covers 12 and 14 of book 10 by an conventional means. These images could be permanently affixed using a variety of adhesives. However, it is contemplated that the reader or readers may wish to replace the images 20 and 22 from time to time. Therefore, the preferred embodiment shows a transparent envelope 24 and 26 with one open end affixed to each cover. Such an envelope would hold each image securely but temporarily, allowing for easy removal and replacement when desired. A three sided framework or a series of slots cut into the front and rear covers for the purpose of accepting the corners of photographs or images 20 and 22 are also contemplated.

While the book 10 encourages the reader to supply images 20 and 22 for use with the book 10, an illustration is placed on the inside surface of the front and rear covers 12 and 14 to make the book functional without separate images. The illustrations are positioned so that the apertures 30 cut in pages 16 superimpose these illustrations. Supplied images 20 and 22, when supplied by the reader would simply be affixed to the inside surface of each cover 12 and 14 directly over the respective illustration.

Mutually corresponding apertures 30 cut in pages 16 may be cut in identical position relative to one another or laterally adjusted slightly on each page 16 to compensate for the binding thickness. Adjustments would not necessarily be required in books containing relatively few pages. However, in books containing more than several pages or pages of substantial thickness such adjustment would ensure that the images were centered within the aperture 30 of each page 16.

It is further contemplated that one or more apertures 30 may be covered with a transparent or translucent material 36, shown in FIG. 3, such as cellophane or a thermoplastic for creating a window effect.

The book 10 is, ideally, purchased by someone other than the reader, who supplies the images 20 and 22. These images 20 and 22 are affixed to the inner surface of the front and rear cover 12 and 14 on the book 10 in a manner previously discussed. The book is given to the child reader who initially views his/her reflection in the mirror 11 on the front cover 12. The reader, upon opening the book 10, discovers an image 20 significant to the reader on the inner surface of the front cover 12. The reader viewing the front surface **16*a* of any page sees an illustration superimposing the image 22 affixed to the inner surface of the rear cover 14 as illustrated in FIG. 3. The image 22 appearing through the aperture 30 completes the illustration and is generally referred to in the text. By turning the page 16 and viewing the back surface 16***b*, the reader once again views an illustration in which the same aperture 30 is now superimposed image 20, thereby completing another illustration. Thus, each aperture is functional when viewed from either direction.

It is thought that the reader will receive an increased enjoyment when viewing illustrations incorporating images 20 and 22 of himself/herself or a subject familiar to the reader.

While in accordance with the patent statutes the best mode and preferred embodiment of the invention has been described, it is to be understood that the invention is not limited thereto, but rather is to be measured by the scope and spirit of the appended claims.

What is claimed is:

1. A book comprising:

a front cover with an inner and outer surface;

a rear cover with an inner and outer surface;

a plurality of leaves hingedly bound between said front and rear covers, each leaf having at least one aperture cut therein, each aperture being in registry with an aperture on the adjacent pages;

a plurality of images removably affixed to the inner surface of said front cover and the inner surface of said rear cover such that at least one aperture of each page is capable of superimposing one image on each cover when said book is open;

a means for removably affixing said images to the inner surface of said covers;

said images, when superimposed, complete the design on each respective page.

2. The book of claim 1 wherein the aperture cut in said leaves are of any geometric shape.

3. The book of claim 2 wherein a transparent or translucent material is disposed on said apertures.

4. The book of claim 2 wherein the apertures of said leaves are cut such that each aperture is centrally superimposed over the image.

5. The book of claim 2 wherein the images are affixed to the inner surface of said front and rear covers by a plurality of transparent envelopes each with at least one open end, said envelopes being affixed to said covers.

6. The book of claim 2 wherein the images are affixed to the inner surface of said front and rear covers by a multi-sided framework, said framework being affixed to said covers.

* * * * *